United States Patent [19]

Pierrel

[11] Patent Number: 4,632,174

[45] Date of Patent: Dec. 30, 1986

[54] DOUBLE BOILER FURNACE FOR VERTICAL ASCENDING PIPE CASTING

[75] Inventor: Michel Pierrel, Pont-à-Mousson, France

[73] Assignee: Pont-a-Mousson S.A., Nancy, France

[21] Appl. No.: 801,729

[22] Filed: Nov. 26, 1985

[30] Foreign Application Priority Data

Nov. 26, 1984 [FR] France ..... 84 18084

[51] Int. Cl.[4] ..... B22D 11/04; B22D 11/10

[52] U.S. Cl. ..... 164/421; 164/439; 164/465; 164/338.1

[58] Field of Search ..... 164/421, 422, 465, 464, 164/439, 483, 488, 121, 122, 133, 338.1

[56] References Cited

U.S. PATENT DOCUMENTS

| | | | |
|---|---|---|---|
| 4,456,053 | 6/1984 | Gourmel | 164/421 |
| 4,506,723 | 3/1985 | Bellocci et al. | 164/421 |
| 4,531,569 | 7/1985 | Fritscher | 164/421 X |

FOREIGN PATENT DOCUMENTS

| | | | |
|---|---|---|---|
| 45-39344 | 12/1970 | Japan | 164/465 |
| 45-39346 | 12/1970 | Japan | 164/464 |
| 57-85653 | 5/1982 | Japan | 164/464 |

*Primary Examiner*—Nicholas P. Godici
*Assistant Examiner*—J. Reed Batten, Jr.
*Attorney, Agent, or Firm*—Sughrue, Mion, Zinn, Macpeak and Seas

[57] ABSTRACT

In a continuous vertical ascending casting installation for iron pipes T, graphite elements 3 defining a molten metal feed chimney 28, a die and coaxial core arrangement 13, 14 and an expansion vessel 16 are mounted under a cover 2 of an electric furnace 1. In use these graphite elements are immersed in a bath of molten metal contained in the hearth area 7 of the furnace, to thus enable precise temperature regulation and control. The outer surface of the die 13 is surrounded by a water cooling jacket 18, and the level of molten iron in the hollow cavity 25 of the core 14 is varied by the expansion vessel 16, to provide even finer control of the temperature gradient within the annular casting space. The overall arrangement is thus similar to a double boiler.

15 Claims, 3 Drawing Figures

X
Y
Z
T
f
Th
N
F
H
1
2
3
4
5
6
7
8
9
10
11
13
14
15
16
16a
17
18
19
20
21
22
23
24
25
26
27
28
28a
29
30
31
32
33
34
35
36
37
38

DOUBLE BOILER FURNACE FOR VERTICAL ASCENDING PIPE CASTING

BACKGROUND OF THE INVENTION

This invention relates to the continuous casting of ferrous alloy tubes, particularly cast iron pipes having thin walls relative to their diameters. More specifically, this invention pertains to the continuous vertical casting of an iron pipe using a tubular die and a heated coaxial core forming, with the die, an annular casting section.

A continuous casting installation for iron pipes with a small thickness/diameter ratio, using a tubular die and a heated coaxial core is described in U.S. Pat. No. 4,236,571. This patent pertains to a descending vertical continuous casting, with the molten iron entering the annular space between the die and the core from above.

Due to the narrowness of the annular passage for the molten iron, the risk of obstruction of the passage by prematurely solidified cast iron in contact with the wall of the tubular die, which is cooled externally by water, is high if the solid-liquid interface, i.e. the limit between the liquid and the solid phases of the cast iron, is not properly controlled. The object of the '501 patent was to define this solid-liquid interface as well as the means of externally cooling the tubular die in order to control this interface, especially at the beginning of the casting.

SUMMARY OF THE INVENTION

This invention addresses the problem of monitoring and regulating the temperature of the molten iron itself, i.e., attention is focused on the liquid phase more than the solid phase in an ascending vertical feed installation through the use of a double boiler system, to avoid the risk of obstruction due to premature solidification in the narrow annular casting space.

This problem is resolved by the invention, which provides an electric furnace for maintaining a desired temperature of a bath of molten iron encompassing a liquid iron feed device for the annular casting space between the die and the core, and an expansion vessel for monitoring and regulating the temperature of the core. The feed device, die, core and expansion vessel are defined by a complex of graphite elements supported by an upper refractory cover of the furnace. The cover is removable such that the feed device can be lifted out of the temperature maintenance bath in the furnace; when the cover is closed and sealed the feed device is immersed in the bath.

To control the temperature of the core, the expansion vessel is connected to the hollow core cavity for regulating the level of molten iron in the cavity.

DETAILED DESCRIPTION OF THE PREFERRED EMBODIMENTS

Figure 1:
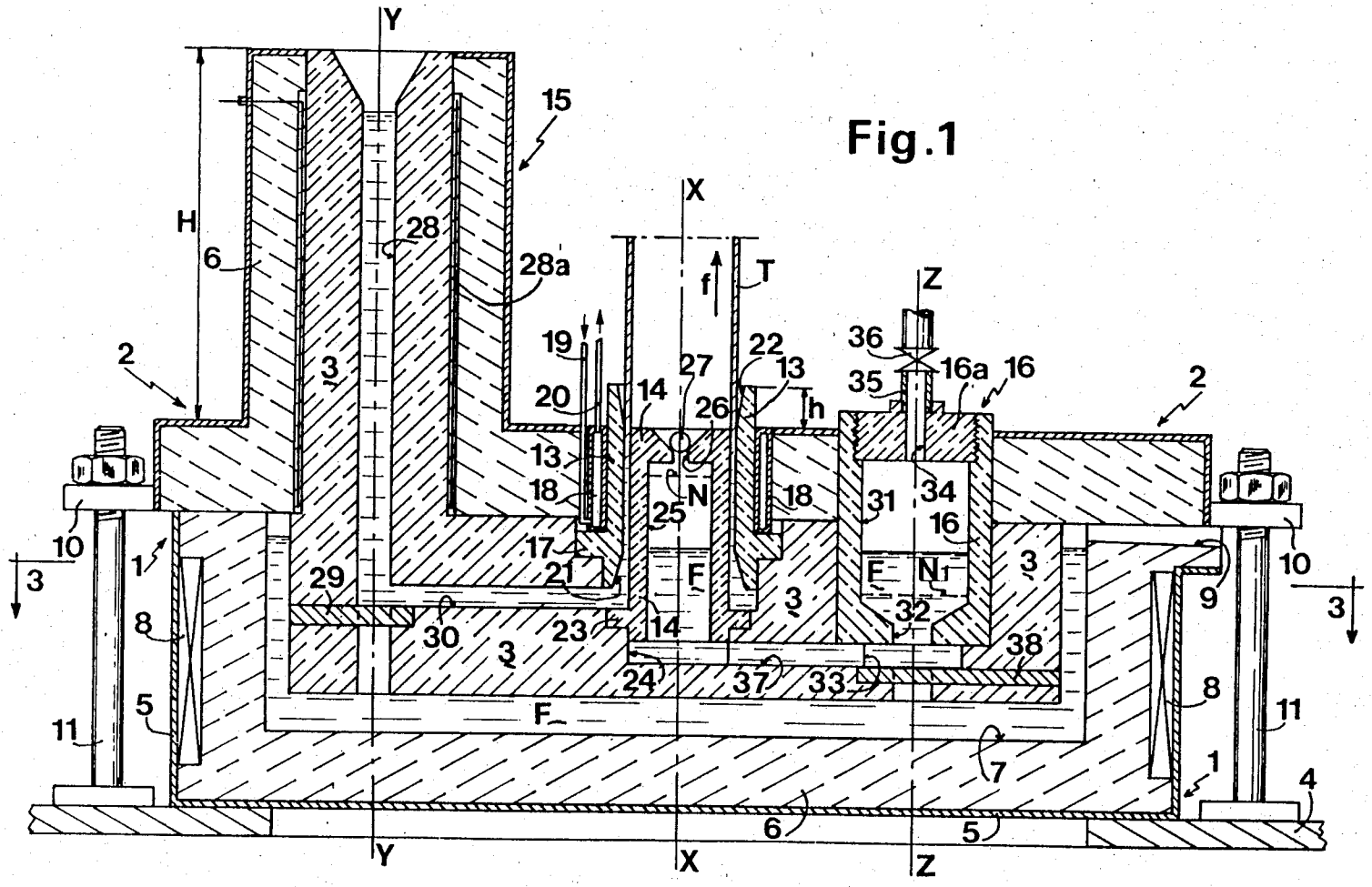
FIG. 1 is a schematic cross-section of an installation according to the invention during the continuous casting of an iron pipe.

In accordance with the embodiment shown in FIG. 1, the installation of the invention essentially comprises an electric furnace 1 in the form of a molten iron receptacle or heating crucible, and a refractory cover 2 for sealing the upper part of the furnace.

The furnace 1 containing molten iron F serves as a temperature maintenance system for the liquid iron feed device borne by the cover 2 and comprising a complex of graphite blocks 3 (shown as being unitary for simplicity).

(1) The Electric Furnace 1

Placed on an open work platform 4 to enable access to the lower part of the furnace, for the drainage thereof through a lower opening which can be sealed (not shown), the electric furnace 1 comprises, within a metal cover 5, a thick refractory lining 6 of silico-aluminous material or the like forming a hearth area 7 to accommodate liquid iron. The furnace is electrically heated by an inductor 8 surrounding the vertical wall of the refractory lining. The furnace also comprises an overflow chute 9. The furnace is sealed by the cover 2, which also comprises an external metal covering and a refractory lining 6 of silico-aluminous material. The cover has a flange 10 cooperating with bolts 11 whose lower ends are connected to the platform 4 such that by tightening the bolts the cover is sealed to the upper part of the furnace through a sealing gasket (not shown) which is compressed between the furnace and the cover, but without blocking the overflow chute 9.

(2) The Cover 2

The cover 2 serves as a support for a system of graphite blocks 3 constituting a cooled die 13 and heated hollow core 14 coaxial to the die around a vertical axis X-X, a molten iron feed device 15 having a vertical axis Y-Y, and an expansion vessel 16 for monitoring and controlling the temperature of the core 14.

When the cover 2 is closed some of the graphite blocks 3 are submerged in the molten iron F.

(3) The X-X Axis Casting System

In greater detail, the casting group comprises a tubular graphite die 13 seated in a cavity in the graphite blocks via a circular external flange 17. The die 13 passes through the refractory lining of the cover 2 and is surrounded by a cooling sleeve 18 over part of its height corresponding approximately to the thickness of the cover lining, the hollow sleeve 18 carrying a coolant fluid such as water or low melting point molten metal, such as lead or tin.

The cylindrical internal wall of the die 13 is tooled with precision, and has a truncated lower portion 21 to facilitate the entry of the liquid metal. Its upper zone 22 is similarly widened to facilitate the disengagement of the pipe being cast.

The hollow cylindrical graphite core 14 is similarly seated in a cavity in the blocks 3 via a lower support flange 23, and forms with the lower portion 21 of the die 13 a wide annular space for the entry of molten iron. The hollow core 14 comprises a cylindrical internal cavity 25 which merges with a circular connection chamber 24 and which, in its upper part, is open to the atmosphere through a conical vent 26 sealed by a graphite gravity ball valve 27.

(4) Y-Y Axis Molten Iron Feed Device

The feed device 15 has a vertical chimney 28 with an upper funnel, on axis Y-Y, of a height H appreciably greater than the height h of the die 13 extending above the cover 2. The chimney extends to the lower wall of the graphite block complex, above the hearth area 7 of the furnace. In its lower part the chimney is blocked by a transverse gate 29, whose opening controls the drainage of the chimney into the hearth area. Above the gate, the chimney 28 is extended by a horizontal conduit 30 which terminates below the conical widening 21 for the entry of the molten iron into the annular space of the casting system. The graphite block(s) defining the chimney are surrounded by a tubular electrical heating resistor 28*a*.

(5) The Z-Z Axis Expansion Vessel

The graphite expansion vessel 16 having a vertical axis Z-Z extends through the cover 2 and has a height corresponding approximately to that of the casting system. The vessel defines a cylindrical cavity 31 having a lower opening 32 issuing into a circular connecting chamber 33, and an upper opening 34 connected by a conduit 35 controlled by a valve 36 to a pressurized source of gas such as air, nitrogen or argon. The vessel 16 is sealed at its upper part by a threaded graphite cover 16*a*. The chamber 33 communicates with the chamber 24 of the casting system via a horizontal conduit 37, and with the hearth area 7 of the furnace via a vertical extension of the opening 32 blocked by a transverse gate 38, the opening of which permits the drainage of the cavity 31 into the hearth area. The expansion vessel 16 monitors and controls the temperature of the core 14.

Operation

The hearth area 7 of the furnace is initially empty or contains a residue bath of molten iron F. The furnace 1 is closed and sealed by its cover 2, with the graphite blocks 3 being suspended above the hearth area of the furnace. Liquid iron is introduced through a filling hole 12 having axis W-W (FIG. 3) up to a level slightly lower than the height of the overflow chute 9. The inductor 8 is energized to heat the furnace.

With cover 16*a* of the expansion vessel removed, molten iron F is introduced into the cavity 31 of the vessel. Since this cavity is connected to the cavity 25 of the core 14, the level of the liquid iron rises at the same time and to the same height in cavities 25 and 31.

The filling of both cavities with molten iron is stopped well below openings 26 and 34, at most at the midpoint of cavity 25. With the cover 16a then being replaced and pressurized gas being introduced through conduit 35 (or conversely conduit 35 being connected to a suction source), the level of liquid iron in the cavity 25 can vary between a lower level shown in solid lines at the height of the widened entry 21 of the die 13 (FIG. 1), and a higher level shown by broken line N just below the ball valve 27.

The chimney 28 is heated by the resistor 28*a* and a coolant fluid such as water is circulated through the conduit 19, the sleeve 18 and the conduit 20. Before the casting of a pipe T is begun, the core 14 is heated by pressurizing the cavity 31 to make the molten iron in the expansion vessel 16 rise in the cavity 25 of the core.

Only the upper part of the core near the opening 26 and ball valve 27 is not heated. This corresponds to the annular area between the die 13 and the core 14 through which the cast iron pipe T is drawn, where the pipe being formed must be cooled externally without being heated internally.

At this point casting is performed by introducing liquid iron through the chimney 28. The iron flows through the horizontal conduit 30, and then rises up through the widened entry 21 of the die 13 under a pressure corresponding to the height of the chimney in the annular space between the die 13 and the core 14.

Through the heating of the core 14 over most of its height the iron in contact with the core remains in a liquid state, while the iron in contact with the cooled die 13 tends to solidify across a solid-liquid interface which becomes progressively thicker from bottom to top (as described in the '501 patent but in the opposite direction since the casting is ascending instead of descending).

The solidification of the cast iron is complete at the upper release zone 22 which allows the pipe T to be freely removed (FIG. 1). By pulling on the pipe in the direction of arrow f utilizing a known extractor (not shown), and by continuing the supply of molten iron through the chimney 28 and removing it from the die 13, a cast iron pipe T is produced.

The external heating of the iron feeding the die and core 13, 14 is ensured by the liquid iron F contained in the hearth area 7 and heated by the inductor 8. The temperature of this iron can be increased by the inductor 8, or if this is insufficient the molten iron in the hearth area can also be replaced by introducing additional molten iron at a higher temperature through the fill opening 12 to replace at least part of the insufficiently hot iron, which exits through the overflow chute 9. The graphite blocks 3 are thus maintained at a proper temperature by a sort of double boiler arrangement, constituted by the iron contained in the hearth area 7 of the furnace.

The monitoring and regulation of the core temperature are effected to obtain, in a continuous manner, a solid cast iron pipe T issuing from the annular space between the die 13 and core 14, i.e., at the level of the upper end of the core. If the cast iron is still in a semi-liquid state when it exits this space and forms mold seams on the outer part of the core, it is because the upper part of the core and/or the cooling sleeve 18 are too hot. The level of iron in the cavity 25 of the core 14 is therefore lowered by decreasing the pressure in the cavity 31 of the expansion vessel, and simultaneously the cooling of the sleeve 18 is enhanced by accelerating the flow of coolant fluid through conduits 19 and 20. These two measures combined, or at least one of them, will re-establish a desired solid-liquid interface with an entirely solid phase of cast iron at the exit from the annular space between the die 13 and the core 14.

Conversely, if the cast iron solidifies inside of the annular space between the die and the core, which requires the casting to be stopped and the die and core system to be disassembled for the placement of at least a new core 14 if the solid cast iron has not adhered to the die 13, it is because the upper part of the core and/or the die 13 are too cool. By restarting the casting with a new core and perhaps a new die 13, the upper part of the core is made hotter by raising the level of iron, for example, to broken line N in the cavity 25, by increasing the pressure in the cavity 31 of the expansion vessel 16. The level in the latter then drops to broken line N1. This establishes a proper solid-liquid interface to obtain a cast iron pipe T.

The monitoring of the temperature of the walls of the die 13 and the core 14 is effected by appropriately placed thermocouples (not shown).

With the annular space between the die and the core thus benefiting from temperature monitoring and regulation, it is possible to cast a very thin pipe since the premature setting of the cast iron or, conversely, the presence of residual liquid in the upper part of the annular casting space is avoided.

As a numerical example, a pipe T has been made having an external diameter of 118 mm and walls only 3 mm thick. Although the invention is not limited to such numerical values, thickness/diameter ratios of about 3/100 are most advantageous.

Any accidental leakage from the die and core system, the feed system 15 or the expansion vessel 16 is collected in the hearth area 7 of the furnace, and any excess molten iron flows out through the overflow chute 9.

Figure 2:
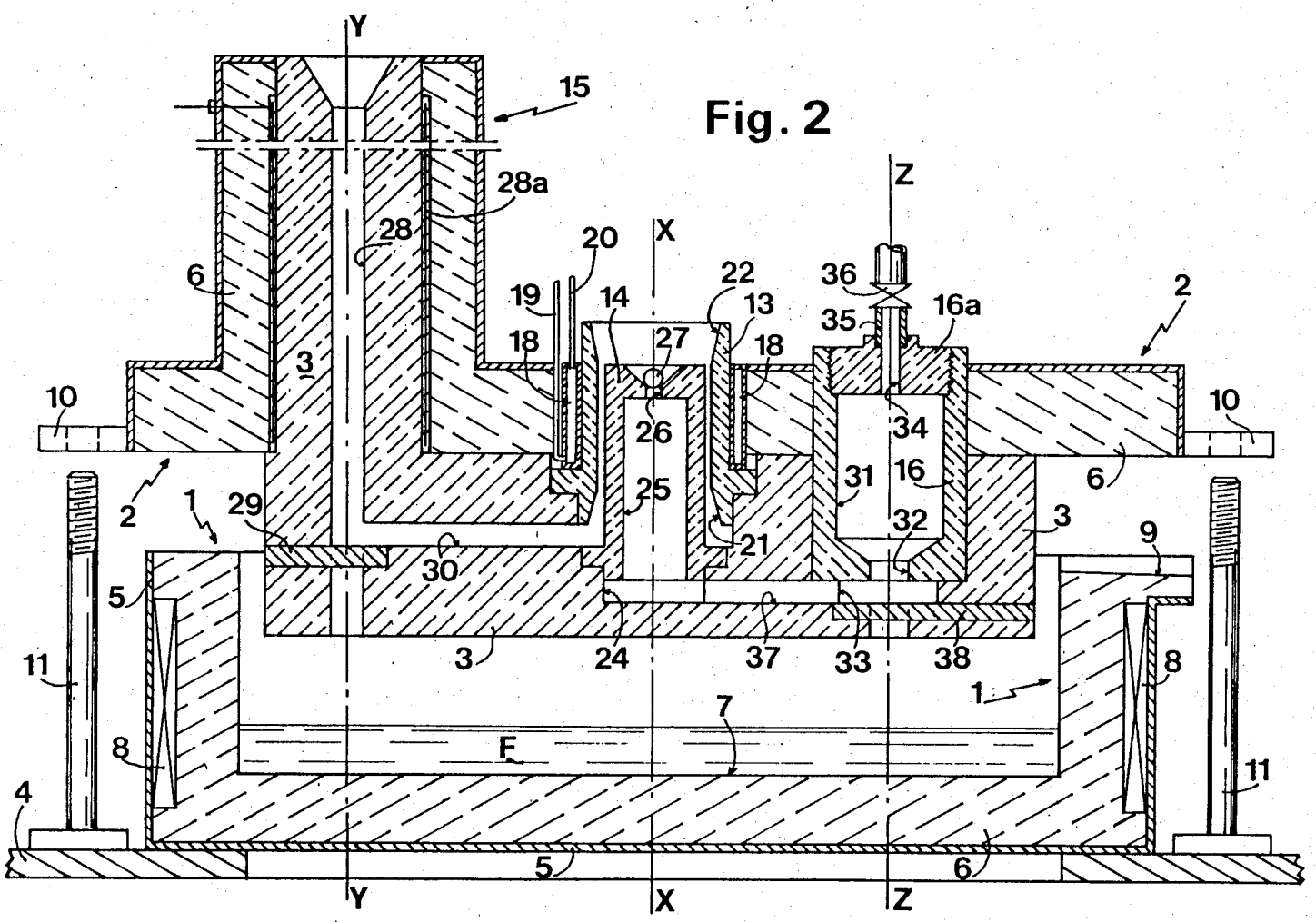
FIG. 2 is a schematic cross-section corresponding to FIG. 1 showing the installation at rest, the cover of the furnace being open and the molten iron feed device being suspended above the electric furnace.

At the end of a casting period, the graphite blocks are drained of molten iron by detaching the cover 2, raising it well above the furnace 1 (FIG. 2), and opening gates 29 and 38. The molten iron then falls into the hearth area 7, which is emptied through drains in the lower part of the furnace (not shown).

Advantages

Through the use of the electric furnace 1 containing a pool of liquid iron in its hearth area 7, the graphite blocks 3 are maintained at a high temperature by being partly submerged in the molten furnace pool. Thus, by controlling only the power applied to the inductor 8, the temperatures of the submerged parts of the graphite blocks constituting the molten iron feed device 15, the die and core 13, 14, and the expansion vessel 16 are simultaneously regulated.

Through the use of connected cavities 31 and 25 in the expansion vessel and the core, and by controlling the level of molten iron in the core cavity with the pressure in the conduit 35, the regulation of the core temperature is ensured in a simple and sure manner. The ball valve 27 acts as a safety valve in the case of excess molten iron in the cavity 25.

Through the filling of the hearth area 7 of the furnace with molten iron and the partial filling of the cavities 31 and 25 with the same liquid iron, and through the introduction of this liquid iron at approximately the same time into the hearth area, the cavity 31 of the expansion vessel and the chimney 28 of the feed device 15, a temperature homogeneity is obtained which is beneficial to the mechanical and thermal expansion tolerances of the graphite blocks 3.

Through the presence of the cooling sleeve 18 on the exterior part of the die 13 and within the refractory lining of the cover 2, thus essentially outside of the graphite blocks 3, no heterogeneity in temperature is communicated to the blocks due to the presence of this cooling element.

Figure 3:
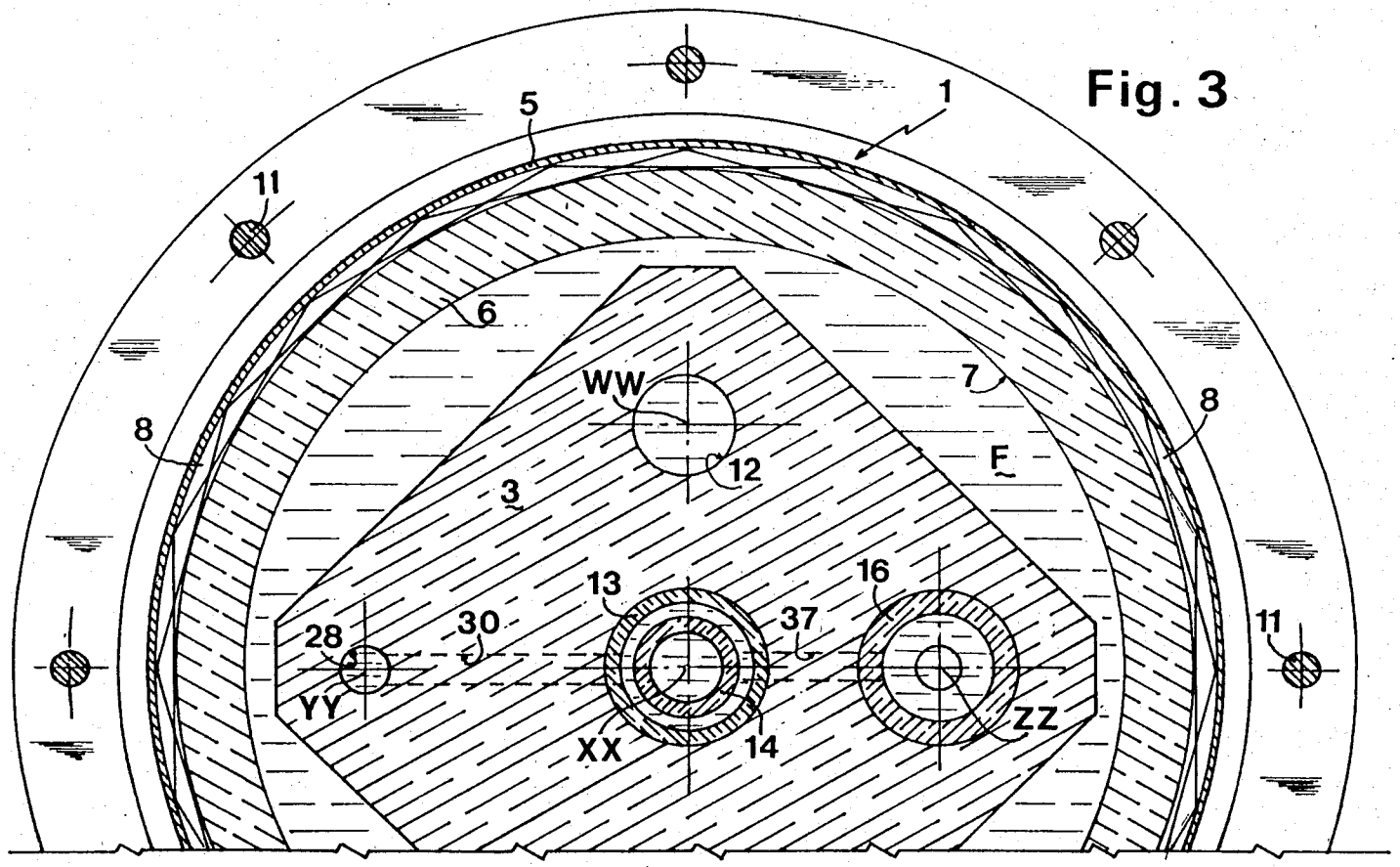
FIG. 3 is a plan view taken on line 3—3 of FIG. 1.

Finally, for reasons of construction facility, the generally cylindrical graphite elements can be advantageously mounted on and secured to the parallelepipedic base block(s) shown in FIG. 3.

What is claimed is:

1. An installation for the continuous vertical ascending casting of iron pipes, comprising:

(a) an electrically heated furnace (1) for maintaining a bath of molten iron (F) therein at a desired temperature, (b) a removable refractory cover (2) for closing an open top of the furnace, (c) a plurality of graphite elements (3) carried by the cover, extending therebelow, and defining:

(1) a tubular die (13) and a coaxial hollow core (14) disposed within the die and defining therewith an annular casting channel, (2) a feed device (15) for supplying molten iron to the casting channel, and (3) an expansion vessel (16) communicating with a cavity (25) of the core for regulating the temperature thereof by controlling the level of molten iron within the cavity, and (d) means (18) for cooling an outer surface of the die, (e) wherein the graphite elements extending below the cover are substantially submerged in the bath of molten iron in the furnace when the cover is closed to define a double boiler arrangement for maintaining molten iron in the feed device, at an entry to the casting channel, in the expansion vessel and in the core cavity at a desired temperature.

2. Installation according to claim 1, wherein an upper end of the core cavity (25) communicates with outside air through a conical opening (26) in the core blocked by a ball valve (27) resting on the opening which serves as its seat.

3. Installation according to claim 2, wherein the expansion vessel (16) comprises a cavity (31) having a lower opening (32) connected to the core cavity and an upper opening (34) connected by a conduit (35) controlled by a valve (36) to a source of pressurized gas.

4. Installation according to claim 3, wherein a lower end of the core cavity communicates with a first circular chamber (24) and a lower end of the expansion vessel cavity communicates with a second circular chamber (33), the circular chambers being connected to each other by a horizontal conduit (37).

5. Installation according to claim 1, wherein the die has upper and lower truncated widenings (22, 21) for the disengagement of a pipe (T) being cast and to facilitate the entry of molten iron into the casting channel.

6. Installation according to claim 1, wherein a lower part of the die has an external circular flange (17) which rests on the bottom of a cylindrical cavity in the graphite elements.

7. Installation according to claim 5, wherein a lower part of the hollow core (14) has an external support flange (23) which rests in a cavity in the graphite elements located below the die (13) to form with the lower widening (21) thereof a wide annular space for the entry of molten iron into the casting channel.

8. Installation according to claim 1, wherein the cooling means comprises a sleeve (18) surrounding the die over part of its height corresponding approximately to the thickness of a refractory lining of the cover (2).

9. Installation according to claim 5, wherein the molten iron feed device (15) comprises a chimney (28) having a height (H) above the cover appreciably greater than the height (h) of the die (13) above the cover.

10. Installation according to claim 9, wherein a tubular electrical heating resistor (28a) surrounds the chimney (28) over a height corresponding to the sum of the height (H) and the thickness of the cover.

11. Installation according to claim 4, wherein the lower opening (32) of the expansion vessel cavity (31) is extended by a vertical passage which opens into a lower surface of the graphite elements and which is blocked by a movable transverse gate (38) whose opening allows the core and expansion vessel cavities to be drained into a hearth area (7) of the furnace.

12. Installation according to claim 9, wherein a lower part of the chimney (28) opens into a lower surface of the graphite elements but is blocked by a movable transverse gate (29) whose opening allows the drainage of the chimney into a hearth area (7) of the furnace, and the chimney is extended at a right angle above the gate by a horizontal conduit (30) which exits below the lower truncated widening (21) for the gravity feed of molten iron into the annular casting channel.

13. Installation according to claim 1, further comprising an overflow chute (9) for excess molten iron in an upper part of the furnace.

14. Installation according to claim 1, wherein the graphite elements (3) comprise a plurality of cylindrical parts mounted on a parallelepipedic block.

15. Installation according to claim 1, wherein the casting channel, the feed device (15) and the expansion vessel (16) have parallel vertical axes.

* * * * *